US006209377B1

(12) United States Patent
Shore et al.

(10) Patent No.: US 6,209,377 B1
(45) Date of Patent: Apr. 3, 2001

(54) HOUSINGLESS ROLL STAND

(75) Inventors: T. Michael Shore, Princeton; Xiaolan Shen, Boylston, both of MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/505,066

(22) Filed: Feb. 16, 2000

(51) Int. Cl.[7] ..... B21B 31/07
(52) U.S. Cl. ..... 72/248; 72/237
(58) Field of Search ..... 72/237, 248, 240

(56) References Cited

U.S. PATENT DOCUMENTS

| | | | |
|---|---|---|---|
| 1,893,196 | | 1/1933 | Buck . |
| 1,927,304 | | 9/1933 | Buck . |
| 4,557,130 | | 12/1985 | Bond . |
| 4,991,420 | | 2/1991 | Frischknecht et al. . |
| 5,142,896 | | 9/1992 | Berger et al. . |
| 5,875,671 | | 3/1999 | Hauck et al. . |
| 6,065,318 | * | 11/1998 | Maniwa et al. ..... 72/237 |

* cited by examiner

*Primary Examiner*—Rodney A. Butler
(74) *Attorney, Agent, or Firm*—Samuels, Gauthier & Stevens

(57) ABSTRACT

A roll stand for a rolling mill, comprising: a support structure adapted to be fixed at a selected location along a mill center line. First and second work rolls are configured and arranged to roll products directed therebetween. The first work roll has roll necks journalled for rotation in bearings contained in first chocks, and the second work roll likewise has roll necks journalled for rotation in bearings contained in second chocks, with the first and second chocks of the work rolls being arranged in pairs located on opposite sides of the mill center line. The first and second chocks of each pair are connected to the support structure for pivotal movement respectively about parallel first and second connecting axes which extend in parallel relationship with respect to the axes of the rolls and orthogonally with respect to the mill center line. An adjustment mechanism is provided for simultaneously pivoting the first and second chocks of each pair in opposite directions about their respective connecting axes in order to symmetrically adjust the parting between the work rolls.

8 Claims, 5 Drawing Sheets

HOUSINGLESS ROLL STAND

BACKGROUND OF THE INVENTION

1. Field of the Invention

This invention relates generally to rolling mills, and is concerned in particular with an improvement in the design of so-called "housingless" roll stands.

2. Description of the Prior Art

In the conventional housingless roll stand, the roll necks of the two work rolls are journalled in bearings contained in pairs of clocks located on opposite sides of the mill center line. The chocks of each pair are interconnected by two screw posts. The four screw posts (two on each side of the mill center line) absorb the roll separating forces during rolling.

The screw posts have opposite hand threaded portions engageable with nuts carried by the chocks. Symmetrical roll parting adjustments are effected by simultaneously rotating all four screw posts.

There are several drawbacks associated with this type of arrangement. For example, insertion and removal of the work rolls and their respective chocks entails painstaking and precise alignment of coacting components, requiring the use of expensive specially designed robotic equipment.

Moreover, the multiple pairs of screw posts and the gear drives required to effect their simultaneous rotation adds significantly to the initial price of each roll stand.

Accordingly, a primary objective of the present invention is the provision of a housingless roll stand which has a simplified compact design, in which only two screw posts are required to effect symmetrical roll parting adjustments.

A companion objective of the present invention is to simplify the task of removing and inserting the work rolls, chocks and associated adjustment mechanisms, thus making it unnecessary to resort to the use of specially designed and expensive robotic equipment.

SUMMARY OF THE INVENTION

A roll stand in accordance with the present invention includes a support structure adapted to be fixed at a selected location along the mill center line. First and second work rolls are configured and arranged to roll products directed therebetween. The first work roll has its roll necks journalled for rotation in bearings contained in first chocks, and the second work roll has its roll necks likewise journalled for rotation in bearings contained in second chocks, with the first and second chocks being arranged in pairs on opposite sides of the mill center line.

The first and second chocks of each roll pair are connected to the support structure for pivotal movement respectively about parallel first and second connecting axes which extend in parallel relationship with respect to the roll axes and orthogonally with respect to the mill center line. An adjustment mechanism simultaneously pivots the first and second chocks of each pair in opposite directions about their respective connecting axes in order to symmetrically adjust roll parting.

Preferably, the adjustment mechanism comprises nut members carried by the first and second chocks of each pair, a pair of threaded posts, one post being associated with each chock pair and having opposite hand threaded portions engageable with the chock nuts, and a remotely operable gear drive for mechanically coupling and simultaneously rotating both threaded posts.

Advantageously, the rotational axes of the rolls lie in a first plane, the chock connecting axes lie in a second plane parallel to and on one side of the first plane, and the threaded posts are contained in a third plane also parallel to the first plane and on a side thereof opposite to that occupied the second reference plane.

Preferably, the support structure includes a pair of link members separably connected to a base, with the first and second chocks of each pair being interconnected by and pivotally connected to one of the link members, and with the rolls, chocks, link members and mechanically interconnected threaded posts being separable as an integral assembly from the base.

These and other objects, features and advantages of the present invention will now be described in greater detail with reference to the accompanying drawings, wherein:

DETAILED DESCRIPTION OF PREFERRED EMBODIMENT

Figure 1:
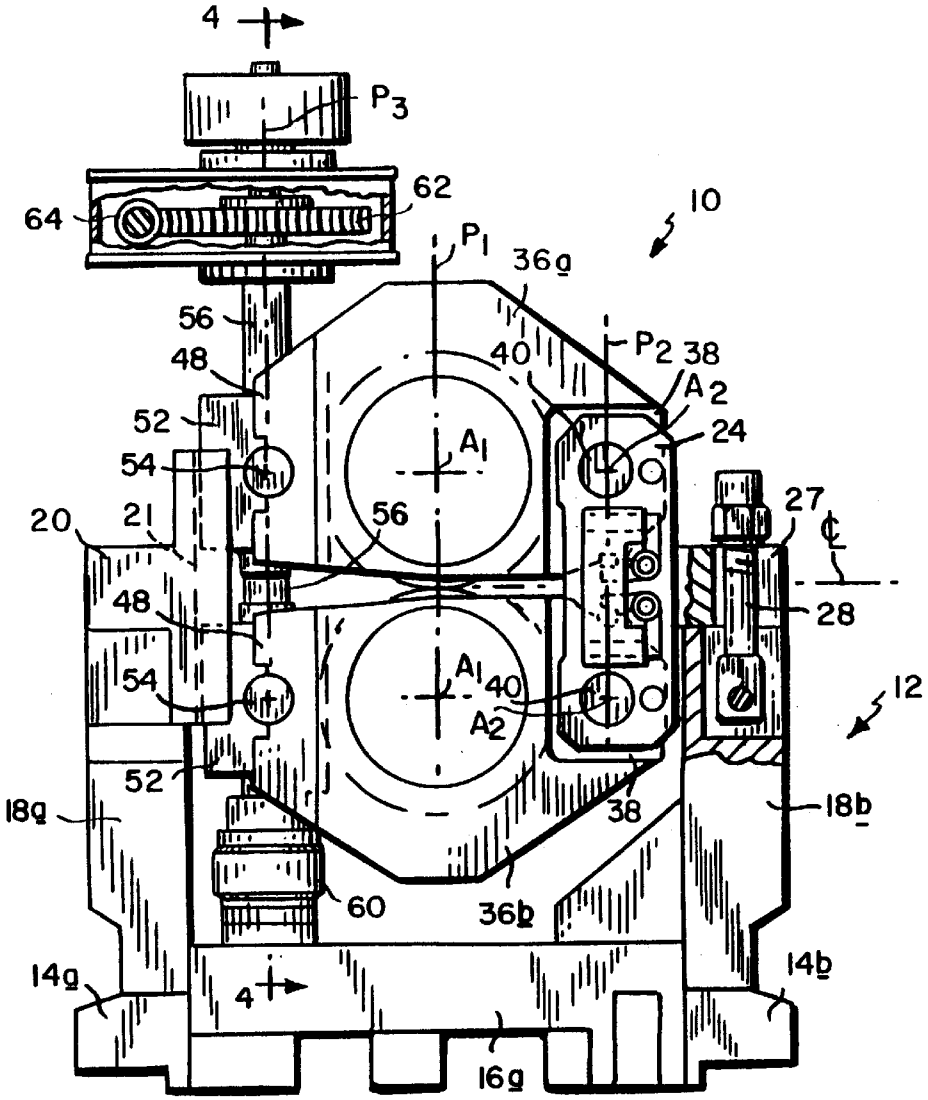
FIG. 1 is a side view of a horizontal housingless roll stand in accordance with the present invention.
Figure 2:
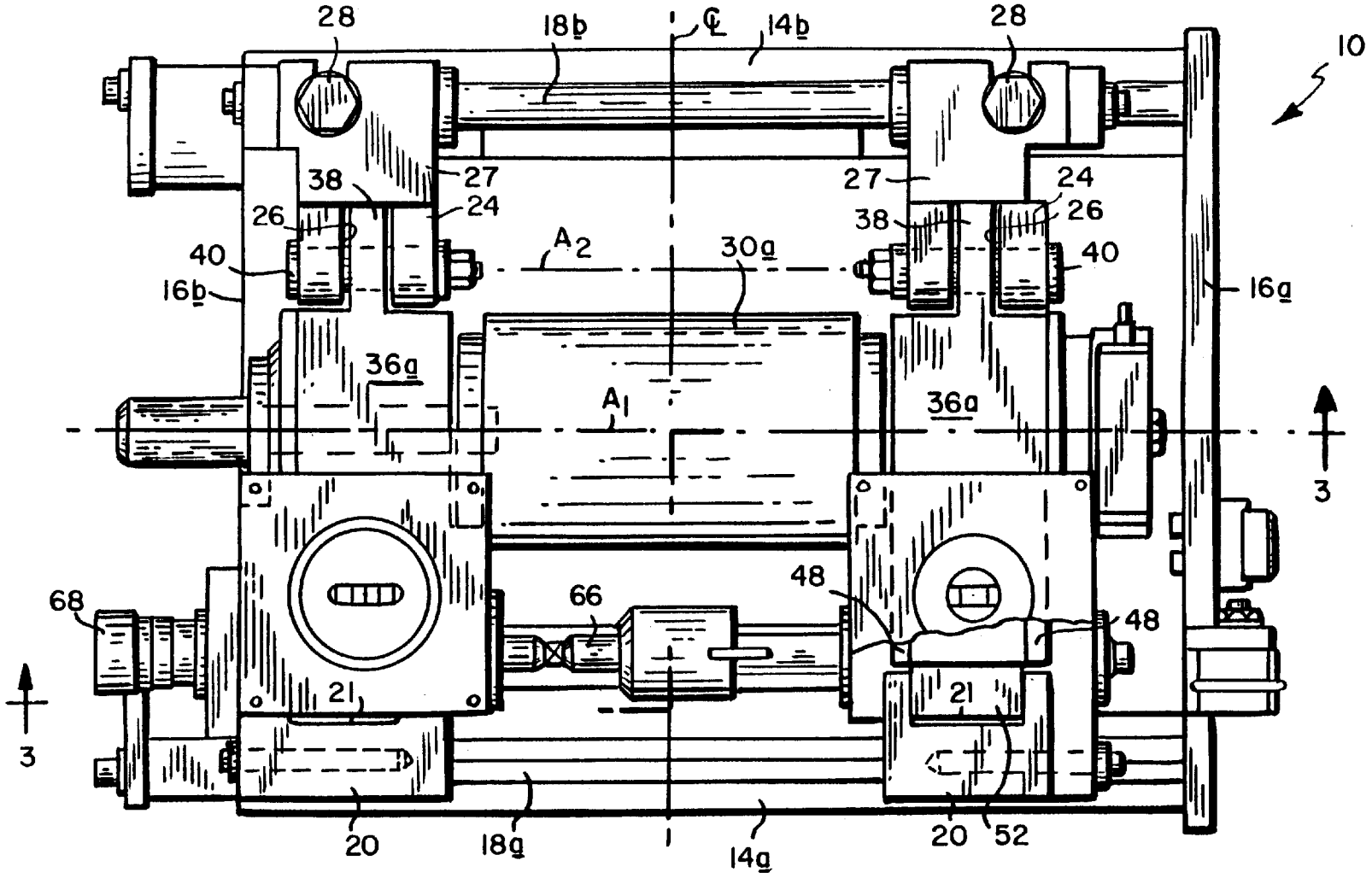
FIG. 2 is a top plan view of the roll stand shown in FIG. 1.
Figure 3:
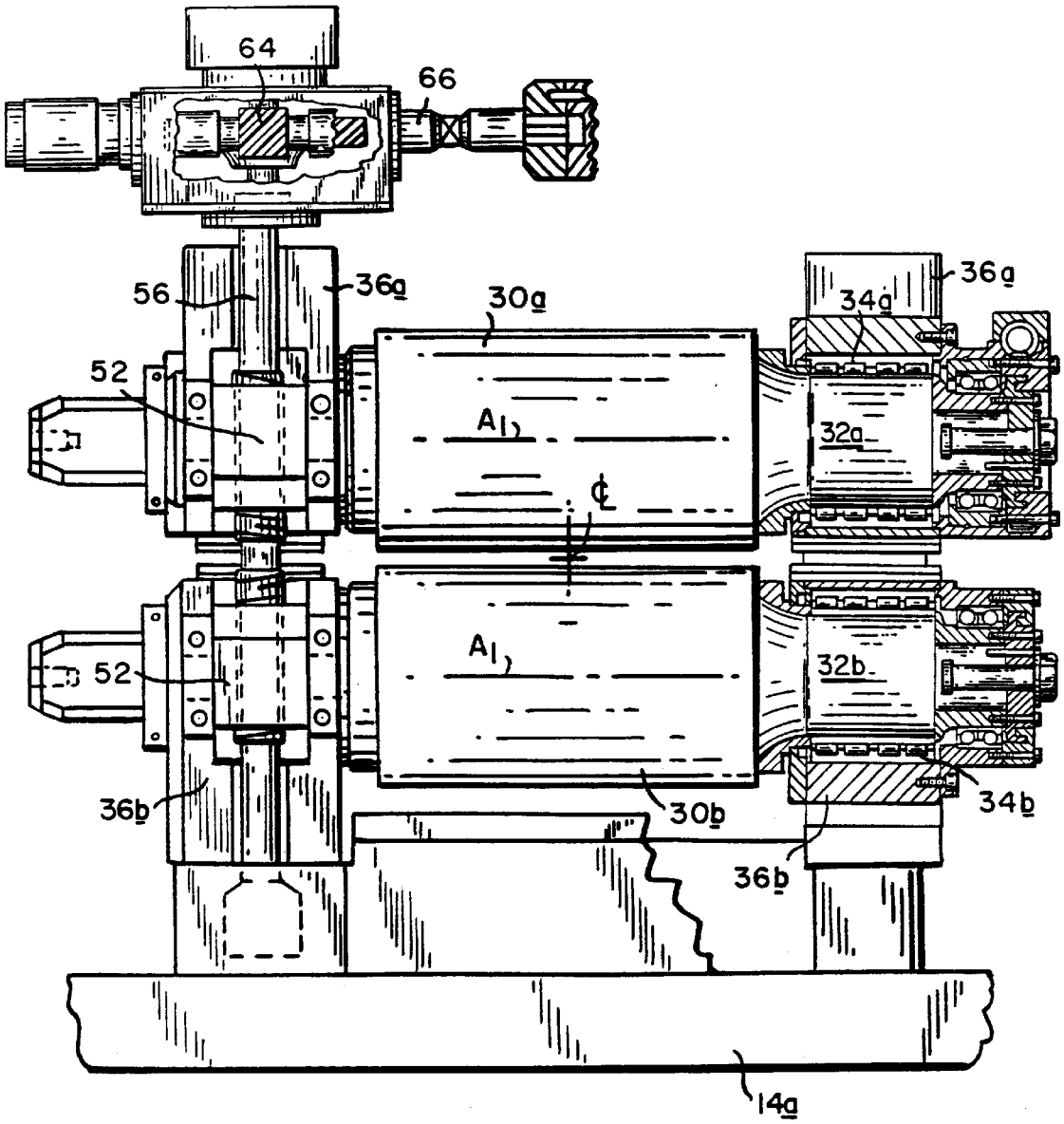
FIG. 3 is a sectional view taken along line 3—3 of FIG. 2.

With reference initially to FIGS. 1–3, a horizontal housingless roll stand in accordance with the present invention is generally depicted at 10. The roll stand includes a support structure generally indicated at 12 adapted to be fixed at a selected location along the mill center line "CL". The support structure has a base comprising a rectangular platform with side members 14*a*, 14*b* interconnected by end members 16*a*, 16*b* and upstanding walls 18*a*, 18*b*. A pair of T-shaped caps 20 are fixed to the upper edge of wall 18*a*. The caps are slotted as at 21.

Disposed oppositely to the caps 20 are links 24 slotted as at 26, with laterally extending arms 27 removably attached to the upper edge of wall 18*b* by means of swing bolts 28.

First and second work rolls 30*a*, 30*b* are located between the support structure walls 18*a*, 18*b*. The work rolls are configured and arranged to roll products (not shown) directed therebetween along the mill center line CL. The first roll 30*a* has its roll necks 32*a* journalled for rotation in bearings 34*a* contained in first chocks 36*a*, and the second roll 30*b* likewise has its roll neck 32*b* journalled in bearings 34*b* contained in second chocks 36*b*. It will be seen from FIG. 3 that the first and second chocks 36*a*, 36*b* are arranged in pairs on opposite sides of the mill center line CL.

The chocks 36*a*, 36*b* have laterally extending flanges 38 received in the slots 26 of the links 24. Robust pins 40 extend through aligned openings in the chock flanges 38 and links 24 to connect the chocks 36*a*, 36*b* to the support structure 12 for pivotal movement about parallel connecting axes $A_2$ which extend in parallel relationship with respect to the rotational axes $A_1$ of the work rolls 30*a*, 30*b* and orthogonally with respect to the mill center line CL.

Figure 5:
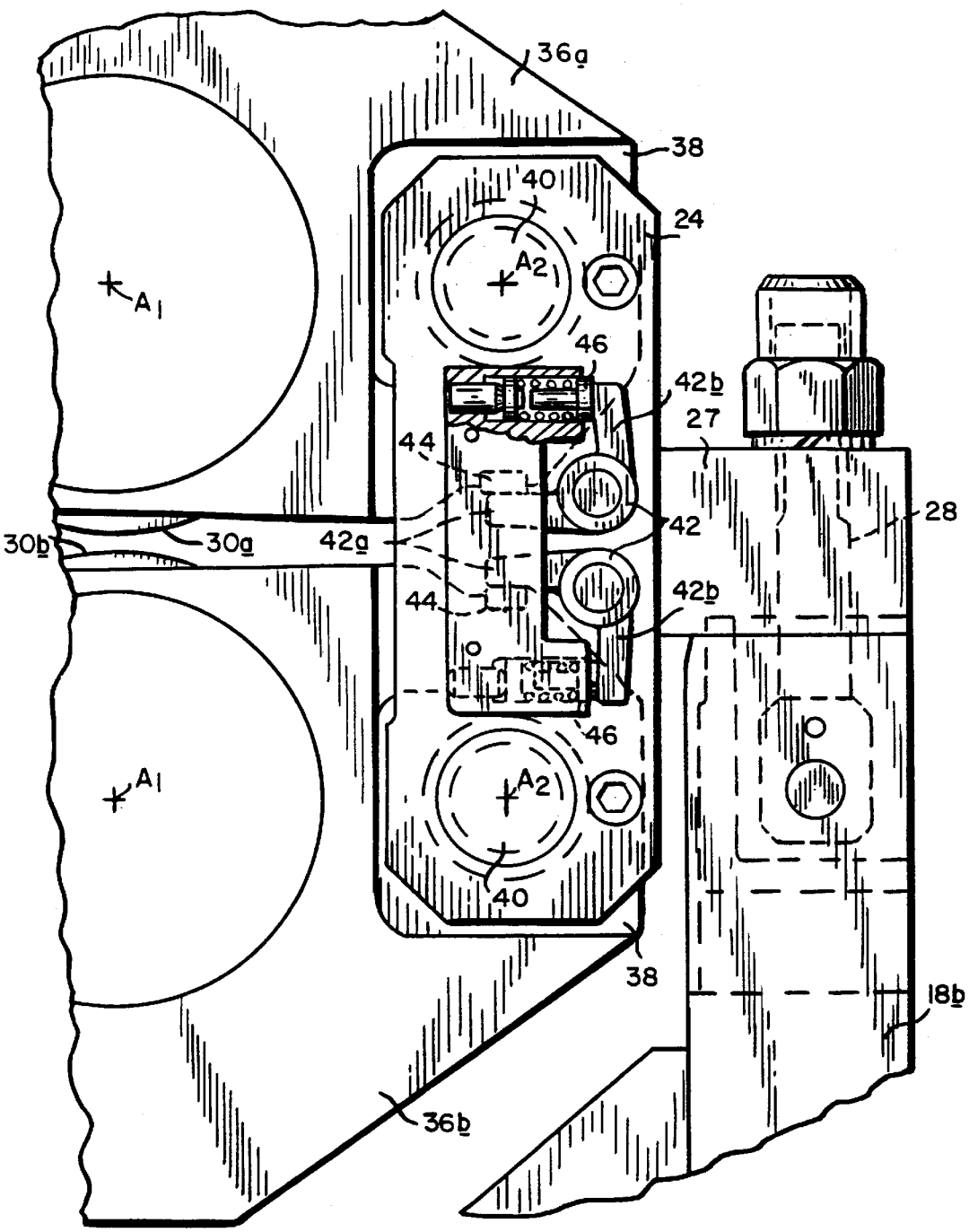
FIG. 5 is an enlarged view of a connecting link and its associated prestressing elements.

As can best be seen in FIG. 5, the links 24 additionally carry rotatable bell cranks 42 having first lever arms 42*a* engageable with contact pads 44 on the chock flanges 38, and second lever arms 42*b* acted upon by spring loaded plungers 46. The plungers 46 act through the bell cranks 42 to resiliently spread the chock flanges 38 and thus take up any clearances existing between them and the links 24 and pins 40.

The opposite sides of the chocks 36*a*, 36*b* are grooved and notched to define laterally spaced cheeks 48 between which are located nuts 50 and captured by caps 52. The nuts 50 have trunnions 54 which project laterally through openings defined by semicircular notches in the cheeks 48 and caps 52.

Figure 4:
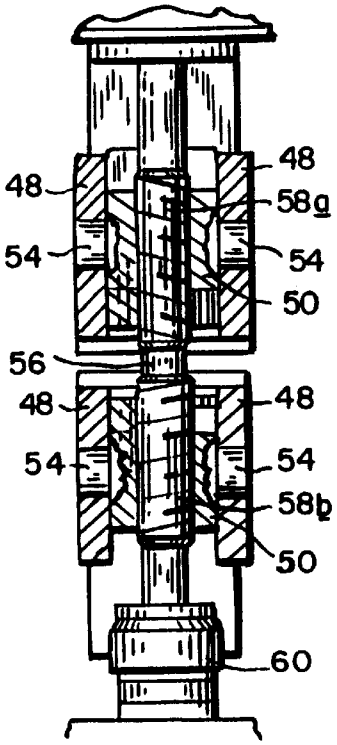
FIG. 4 is a sectional view taken along line 4—4 of FIG. 1.

A pair of screw posts 56 is provided, one on each side of the mill center line CL to service a respective pair of chocks 36*a*, 36*b*. As can best be seen in FIG. 4, each screw post has opposite hand threaded portions 58*a*, 58*b* engaged respectively with one of the nuts 50 carried by each chock of a given pair. The lower ends of the screw posts are supported on the base platform by pillow blocks 60 and are provided at their upper ends with gears 62.

It will be seen from FIG. 1 that the axes $A_1$ of the work rolls lie in a first reference plane $P_1$. The connecting axes $A_2$ lie in a second reference plane $P_2$ on one side of reference plane $A_1$, and the screw posts 56 lie in a third reference plane $P_3$ on the side of plane $P_1$ opposite to that occupied by reference plane $P_2$.

The gears 62 are engaged by worms 64 carried on a cross spindle 66 driven by a motor 68. The motor 68 is remotely operable to simultaneously rotate the screw posts 56, which in turn act through the chock nuts 50 to simultaneously pivot the chocks 36*a*, 36*b* of each pair in opposite direction to thereby symmetrically adjust the parting between the rolls 30*a*, 30*b*.

Only two screw posts with minimal gearing are required to effect such adjustments. The first, second and third planes $P_1$, $P_2$ and $P_3$ respectively containing the roll axes $A_1$, connecting axes $A_2$ and screw posts 56 are tightly arranged with minimum spacing therebetween, thereby providing a compact assembly.

Figure 6:
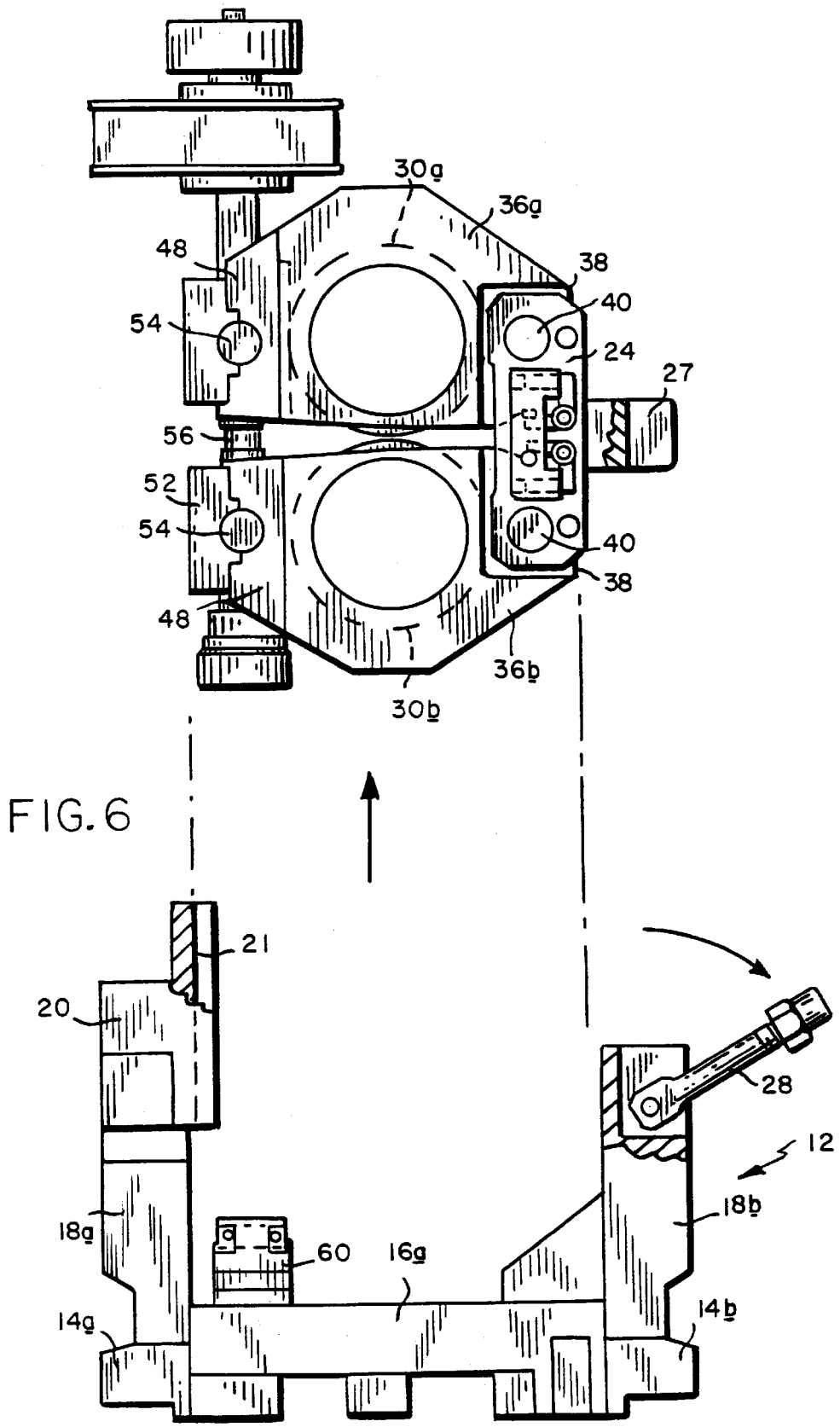
FIG. 6 is a view similar to FIG. 1 showing the roll stand in a disassembled state.

As shown in FIG. 6, by simply loosening and dislodging the swing bolts 28, an integral assembly comprising the rolls 30*a*, 30*b*, chocks 36*a*, 36*b*, links 24 and screw posts 56 with associated coupling and drive components can be lifted away from the support structure 12 and quickly and easily replaced with a replacement assembly. This can be accomplished by conventional lifting equipment without having to utilize specially designed robotic tools.

The compact nature of the design and the pivotal interconnection of the chocks is highly resistant to deflection under rolling loads.

In light of the foregoing, it will now be appreciated by those skilled in the art that various structurally and functionally equivalent components may be substituted for those herein illustrated and described without departing from the spirit and scope of the invention as defined by the claims appended hereto. For example, other types of adjustment mechanisms including hydraulically actuated cylinders and the like may be employed to pivotally adjust the chocks. The roll stand may be of the horizontal type, as illustrated, or of the vertical type.

We claim:

1. A roll stand for a rolling mill, comprising:

a support structure adapted to be fixed at a selected location along a mill center line;

first and second work rolls configured and arranged, to roll products directed therebetween, said first work roll having roll necks journalled for rotation in bearings contained in first chocks, and said second work roll likewise having roll necks journalled for rotation in bearings contained in second chocks, with the first and second chocks of said work rolls being arranged in pairs located on opposite sides of the mill center line;

means for pivotally connecting the first and second chocks of each of said pairs to said support structure for pivotal movement respectively about parallel first and second connecting axes which extend in parallel relationship with respect to the axes of said rolls and orthogonally with respect to the mill center line; and adjustment means for simultaneously pivoting the first and second chocks of each of said pairs in opposite directions about said connecting axes in order to symmetrically adjust the parting between said work rolls.

2. The roll stand of claim 1 wherein the rotational axes of said rolls lie in a first reference plane, and said connecting axes lie in a second plane located on one side of said first reference plane.

3. The roll stand of claim 1 wherein said rolls, chocks and adjustment means are removable as an integral assembly from said support structure.

4. The roll stand as claimed in claim 1 wherein said support structure includes link members removably secured to a base, and wherein the first and second chocks of each of said pairs are interconnected by and pivotally connected to said link members.

5. The roll stand of claim 2 wherein said adjustment means comprises nut members carried by the first and second chocks of each said pairs, a spindle associate with each of said pairs and having opposite hand threaded portions threaded through said nut members, and means for simultaneously rotating said spindles.

6. The roll stand of claim 5 wherein said spindles are arranged in a third reference plane parallel to said first reference plane and on a side thereof opposite that in which said second reference plane is located.

7. The roll stand as claimed in claim 4 wherein said rolls, chocks, link members and adjustment means are removable as an integral assembly from said base.

8. In a housingless roll stand arranged on a mill center line and having work rolls with roll necks rotatably supported by bearings contained chocks, there being a pair of said chocks located on opposite sides of the mill center line, the improvement comprising: each pair of chocks being interconnected by and pivotally connected to a link located on one side of a plane containing the roll axes and being interconnected by a screw post located on the opposite side of said plane and having opposite hand threaded portions engaging nuts carried by said chocks, and means for mechanically coupling and simultaneously rotating said screw posts to pivotally and symmetrically adjust the roll chocks of each pair.

* * * * *